United States Patent [19]

Higgins et al.

[11] Patent Number: 5,014,979

[45] Date of Patent: May 14, 1991

[54] SIGNATURE MACHINE

[75] Inventors: George D. Higgins, Orland Park; Thomas A. Nelson, Jr., Oak Lawn, both of Ill.

[73] Assignee: McCain Manufacturing Corporation, Chicago, Ill.

[21] Appl. No.: 514,284

[22] Filed: Apr. 25, 1990

[51] Int. Cl.[5] ..... B65H 5/10

[52] U.S. Cl. ..... 271/104; 271/31.1; 271/107; 271/150; 271/276

[58] Field of Search ..... 271/31.1, 107, 104, 271/150, 276

[56] References Cited

U.S. PATENT DOCUMENTS 3,608,893 9/1971 McCain ..... 271/256

4,588,180 5/1986 Ballestrazzi ..... 271/31.1 X

*Primary Examiner*—Richard A. Schacher

*Attorney, Agent, or Firm*—Kinzer, Plyer, Dorn, McEachran & Jambor

[57] ABSTRACT

Cyclically operable signature machine having a one-way drive to incrementally advance a signature infeeding conveyor synchronously to the action of an oscillating suction finger for withdrawing a signature from a stack in a hopper; in a cycle where a signature is not to be fed, the suction finger is latched and simultaneously the one-way drive is disabled to prevent the stack from being compacted.

5 Claims, 3 Drawing Sheets

SIGNATURE MACHINE

BACKGROUND OF THE INVENTION

This invention relates to a cyclically operable signature machine in which signatures (folded sheets) are withdrawn from a supply hopper or magazine sequentially in timed relation and delivered to a signature gatherer, one atop another, eventually to complete a book.

Typical machines of the kind contemplated by the present invention are disclosed in U.S. Pat. Nos. 3,608,893 and 4,241,907, each of which discloses the operation of a so-called suction finger, controlled by a cam, for repeated oscillatory movement, successively to withdraw the leading signature from the supply hopper. However, in the instance of assembling the books on the basis of demographic standards, there may be instances where a signature is to be skipped or passed. As disclosed particularly in U.S. Pat. No. 3,608,893, the suction finger in such an instance will be latched in its advanced position quite close to the signature next to be delivered. There are instances where the latched state may prevail for several hundred cycles.

In more precise terms, the suction finger is mounted on a bell crank which has a cam follower spring biased against a continuously rotating cam responsible for synchronously operating the bell crank in accordance with the machine cycles. The sucker finger arm (or bell crank) carries a second roller, and when the suction finger is to be latched a notch in an actuated latching arm is presented to the second roller, capturing it and preventing return movement of the suction finger. Nonetheless, there must be allowance for some play in the latched position (a few thousandths of an inch). This is so in order that the latch can easily be released timely, and the cam follower accurately and gently returned to the cam contour rather than forcefully striking it.

This describes the latch disclosed in U.S. Pat. No. 3,608,893, with the understanding that the latching roller can be differently located, the notch of the latch differently configured and setting or actuation of the latch accomplished in different ways. The point is the suction finger is to be disabled, that is, prevented from oscillating when a signature is not to be withdrawn.

A thorough understanding of the background of the present invention also requires an explanation of the manner in which the signatures are moved forwardly in the supply hopper so that the forwardmost signature will be accurately positioned to the stroke of the suction finger. In achieving this, normal operation of the suction finger is accompanied by synchronous indexing (incremental movement) of a one-way clutch (or one-way pawl and ratchet as is sometimes used) which in turn is responsible for indexing a pair of roller chains or an equivalent infeeding conveyor to index the stack of signatures forwardly a few thousandths of an inch, compensating for the slack or space of each signature.

These synchronous movements and latching operations have proven to be eminently satisfactory in commercial practice, but if a there is a sparse supply of signatures in the hopper, such as in the instance of automatic loading, the resultant short supply can result in the latched-up suction finger and the one-way conveyor drive means opposing one another resulting in a jam due to the stack becoming too tight, too compacted. Thus, as mentioned above, the suction finger, even though latched, must be allowed to have a slight amount of motion (bell crank motion) under the influence of the cam. This motion or "play" is transmitted to the one-way clutch which indexes the conveyor a slight amount. As will be explained in more detail below, the latched-up finger will in fact nudge the forwardmost signature, because of the play, and repeated nudging can result in repeated operation of the one-way clutch, forcing the signatures forwardly at a time when none is to be fed.

The primary object of the present invention is to compensate the machine for low level or quantity of signatures in the supply hopper, thereby to prevent the stack of signatures from being compacted when the suction finger is latched.

SUMMARY OF THE INVENTION

As noted above, operation of the one-way drive for the signature conveyor is timed to occur concurrently with and as an incident to the suction finger withdrawing the forwardmost sheet from the hopper and because of the need to allow limited idle motion of the suction finger support, when the suction finger is motion of the suction finger support, when the suction finger is latched, the one-way drive member continues to be indexed slightly, causing the stack of signatures to be compacted. Under and in accordance with the present invention, the mechanical linkages, coupling the suction finger and the one-way drive control, are disabled when the suction finger is latched. Stated in other words, the problem presented by failure to optimize the supply of signatures, allowing that supply to reach a collection of six inches or less as a collective thickness, is solved by interposing a "NO" command to the one-way conveyor drive control simultaneously with latching the suction finger.

DETAILED DESCRIPTION

Figures 1, 1A:
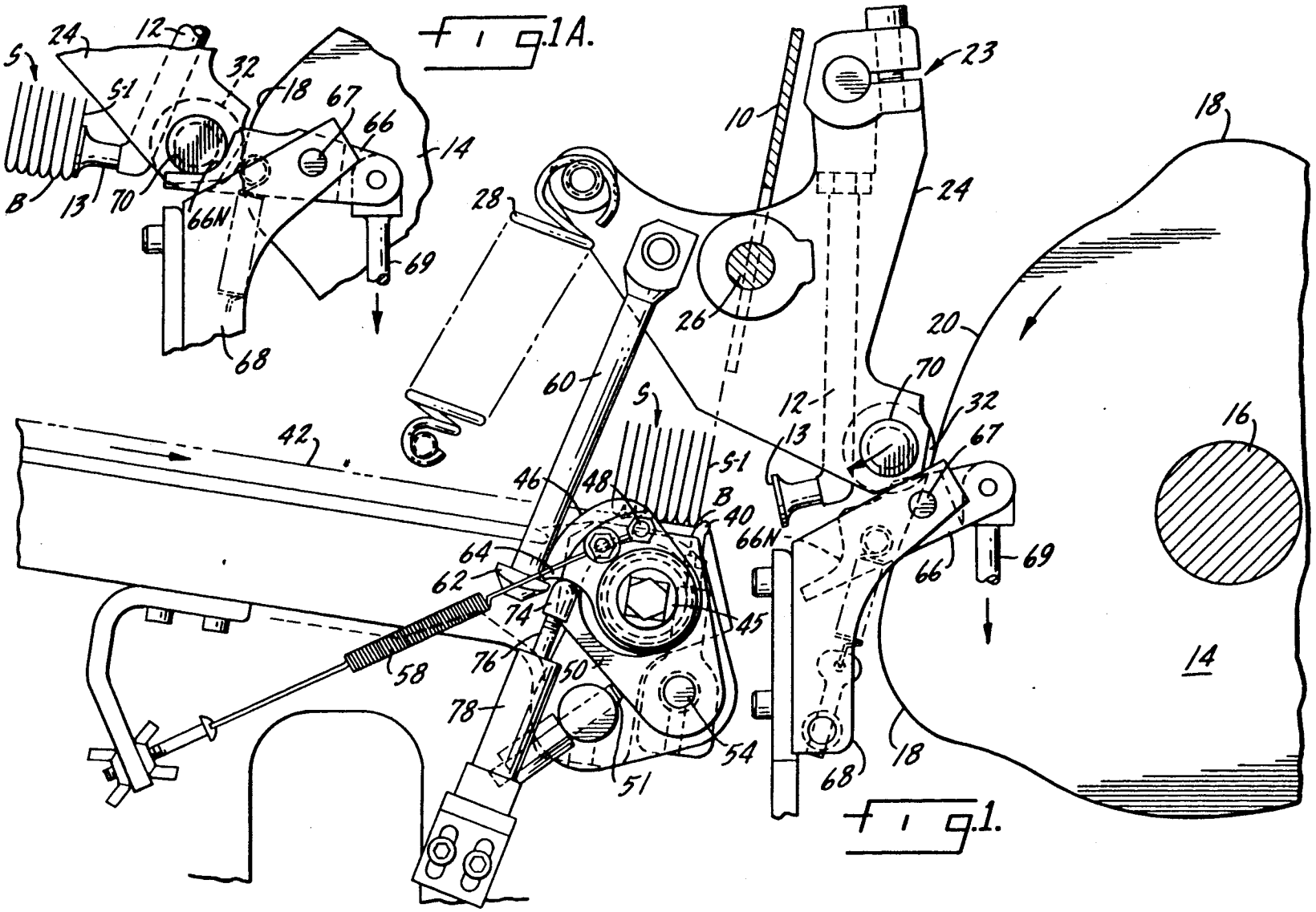
FIG. 1 is an elevation of one form of feeder mechanism in a signature machine addressed by the present invention.
FIG. 1A is a fragmentary detail view of one way of latching the suction finger.

Referring to FIG. 1, signatures S are shown in a vertical or upright position at the forwardmost end of a supply hopper 10. Only eight signatures are shown, signifying a diminimus supply giving rise to the problem.

In normal operation, the forwardmost signature S-1 will be withdrawn by an oscillating suction finger 12 having a suction cup 13 to which suction (negative pressure) is constantly supplied. Oscillation of the suction finger, back and forth, is accurately timed and synchronized by a cam 14 continuously rotated by a cam shaft 16. The cam has accurately spaced lobes 18 and intermediate dwells 20. Each cam lobe represents a machine cycle.

The suction finger at 23 is clamped to a bell crank 24 pivotally mounted on a shaft 26. One arm of the bell crank 24 is connected to a spring 28 responsible to urge the bell crank 24 counterclockwise as viewed in FIG. 1. Another arm of the bell crank carries a cam follower 32 so that the cam follower is constantly urged against the contour of the operating cam 14.

When the topmost cam dwell 18 shown in FIG. 1 engages the cam follower 32, the bell crank 24 is rocked clockwise as viewed in FIG. 1. The cup 13 of the suction finger is pressed against the leadingmost signature S-1, capturing it by suction, and as the cam dwell is presented to the follower 32, the bell crank is returned or rocked in the counterclockwise direction. The signature gripped by suction is thus withdrawn and in doing so passes over a governor finger 40. The governor pin 40 serves partly in the role of a stop accurately to locate the leadingmost signature in position be extracted. The withdrawn signature is delivered to a so-called extracting cylinder (not shown) of the kind disclosed in McCain U.S. Pat. No. 4,241,907. Further, by means not shown herein, the folded sheets constituting the signature are opened and dropped onto a saddle conveyor if a saddle conveyor is employed. The present invention, however, may be applied equally well to a flat gatherer.

Figures 2, 7:
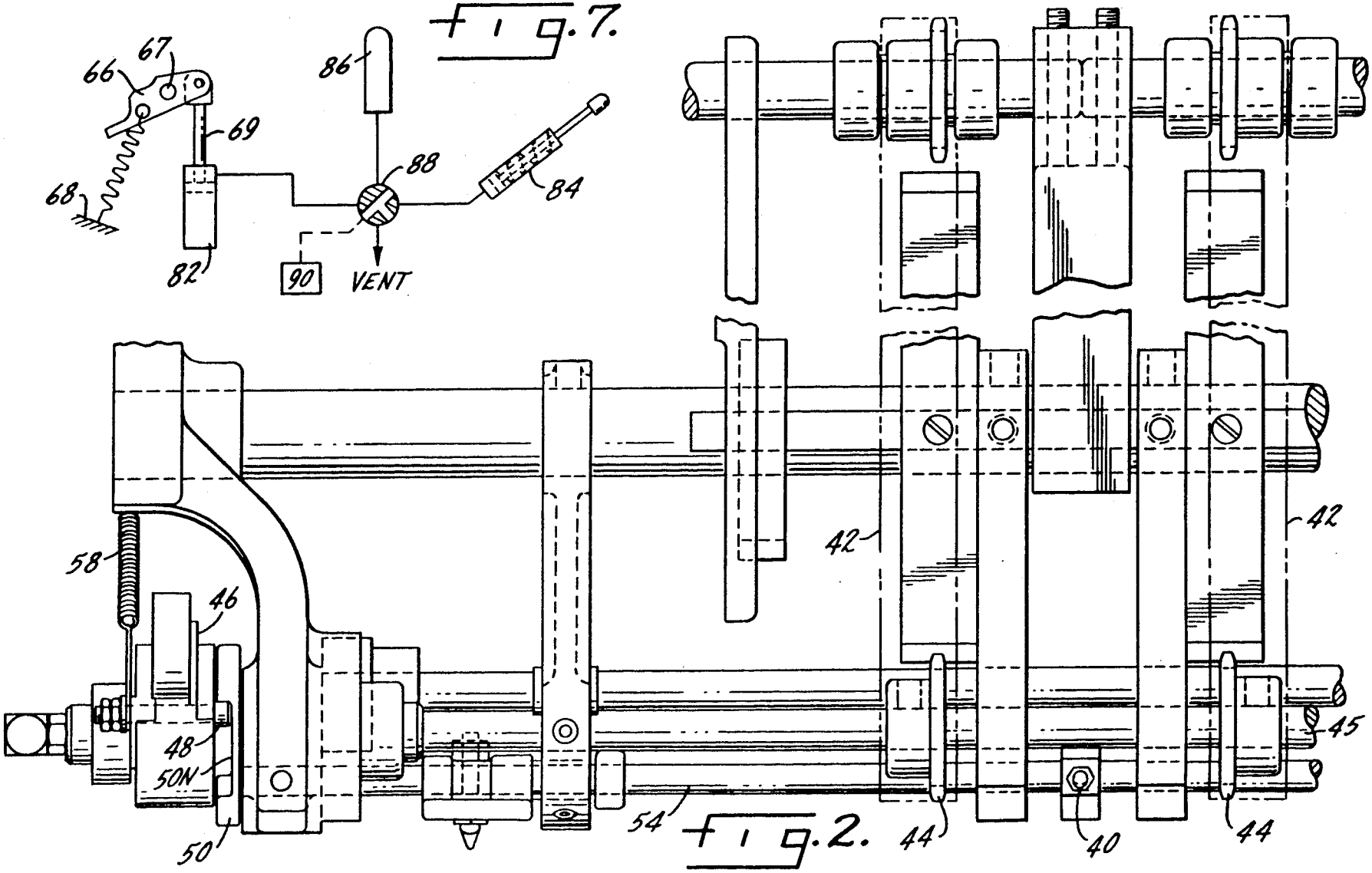
FIG. 2 is a top plan view of the mechanism shown in FIG. 1.
FIG. 7 is a schematic view of an air control.
Figure 3:
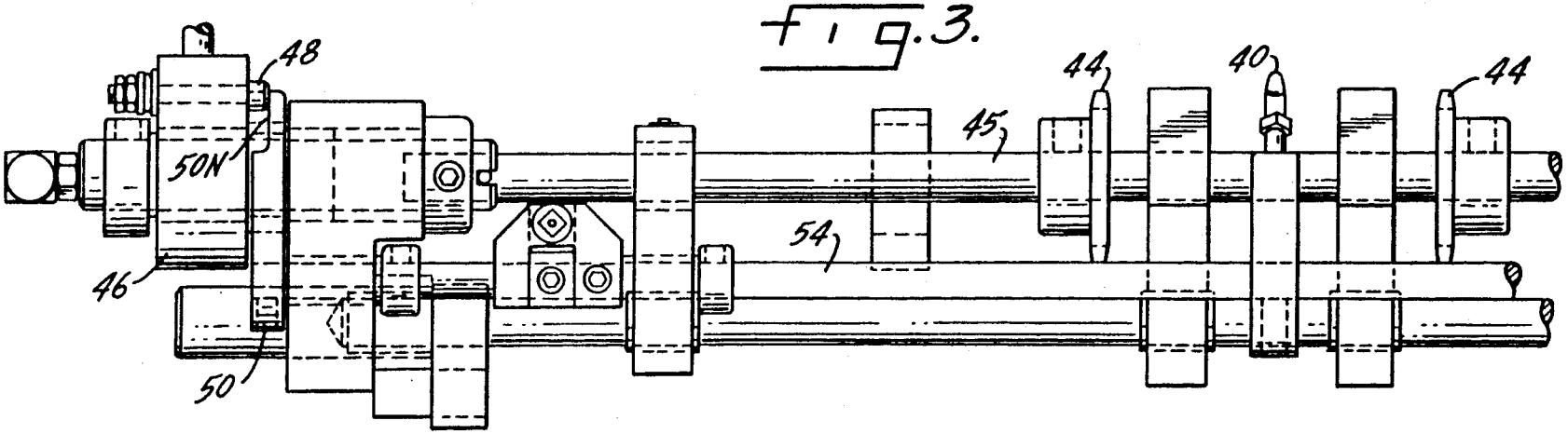
FIG. 3 is a detail elevation showing the so-called governor finger and related parts at the front of the hopper.

In the course of operation, the signatures are incrementally advanced or indexed in the direction of the governor or control finger 40 by roller chains 42, FIG. 2, incrementally driven by sprockets 44, which in turn are secured for rotation to a sprocket drive shaft 45. It will be noted in FIG. 1 that the fold or backbone B of each signature rests on the infeeding conveyor 42.

Referring to FIG. 1, the sprocket drive shaft 45 is indexed, in a manner to be described, by a one-way clutch 46 of the well-known form in which the clutch has a one-way tapered roller race which "couples" the clutch elements to index the conveyor drive shaft 45 when clutch 46 is incrementally turned clockwise as viewed in FIG. 1, whereas the clutch roller race is ineffective in the return direction. In FIG. 1, the clutch 46 is in its restored or retracted position, ready to be actuated to its advanced position, the corresponding increment of movement being transmitted to the conveyor shaft 45. Thus, intermittent movements of the clutch in the clockwise direction as viewed in FIG. 1, in accordance with the machine cycles, results in corresponding indexing movements of the roller feed chains 42 indexing a few thousandths of an inch to advance the signature stack forwardly as an incident to removal of a signature. The clutch has a stop pin 48, FIG. 1, normally engaged with a rear shoulder presented by a notch 50N in a "shroud" or control lever 50, FIG. 2. An adjustable stop 51, FIG. 1, engages an edge of the shroud to limit the retracted position of the clutch. The control lever 50 is affixed to a governor pin shaft 54 to which the above-identified governor pin 40 is itself fixed.

The governor pin 40 is normally positioned, FIG. 1, so that it is presented to the backbone or fold B of the foremost signature as S-1 in the signature infeed pile. The governor pin is urged or biased to this position by a spring 58, FIG. 1, anchored to the machine at one end as shown in FIG. 1, and at the opposite end anchored to the one-way clutch housing as shown in FIG. 2. Thus, the spring 58 is effective to hold the clutch pin 48 rearward against the stop shoulder presented by the notched lever 50 and in turn, in this manner, a counterclockwise bias is imposed on the governor pin shaft 54, accurately positioning the governor pin 40 as shown in FIG. 1.

The one-way drive clutch is synchronized to the bell crank 24 so that infeed conveyor 42—42 will be indexed or advanced incrementally each time a signature is withdrawn during continuous cyclical operation of the machine manifest in continuous rotation of the cam 14. To synchronize the suction finger motion and clutch drive, a reciprocating drive link 60, FIG. 1, is pivotally connected at its upper end to the bell crank 24. At the lower end it has a lug 62 engaged with an ear 64 on the clutch. Thus, as the bell crank 24 is turned clockwise as viewed in FIG. 1, at the time the topmost cam lobe 18 is pushing on the cam follower 32, the lever 60 is raised; and consequently the clutch housing 46 is turned in the clockwise direction as viewed in FIG. 1, which is its driving or "coupled" state, stretching spring 58. In turn, the conveyor belt drive shaft 45 is turned clockwise through a few degrees of indexing movement, advancing the pack of signatures forwardly or to the right as viewed in FIG. 1. This takes place as the suction finger 12 is pressed against the forwardmost signature S-1 in the stack, the stack in turn being pushed against the suction cup.

When a cam dwell 20 is presented to follower 32, spring 28 returns the bell crank and the suction finger 12 pulls the forwardmost signature across the governor finger 40. Also, when a cam dwell is presented to the cam follower 32, link 60 drops and the clutch housing 46 is restored in the counterclockwise direction to its retracted position by spring 58. Concurrently, pin 48 restores the shroud 50 to the position shown in FIG. 1. At the same time, shroud 50 turns shaft 54 to restore the governor pin.

In summary to this point, an instantaneous static condition is shown in FIG. 1 where signature S-1, next to be withdrawn, is up against the governor finger 40. The governor finger 40 is held in this position by the bias applied to the shaft 54 through return spring 58. The one-way clutch is in its restored, stand-by position, ready for the next incremental movement. A moment later, the topmost cam lobe 18, FIG. 1, engages the cam follower 32, forcing the suction finger 12 to the left as viewed in FIG. 1. Link 60 actuates the clutch 46 at the time bell crank 24 is rocking in the clockwise direction, causing the signature stack to be indexed forwardly a few thousandths of an inch. Signature S-1 is withdrawn past the governor finger 40 as the cam dwell (the dwell which follows the topmost lobe 18) is presented to the cam follower 32, due to the bias of spring 28 on the bell crank 24; concurrently, link 60 is dropped and spring 58 returns the clutch through its retrogressive idle motion. The governor finger 40 is free and consequently the shroud 50 is also restored until it strikes stop 51. Accuracy in locating the clutch and the shroud 50 in the restored position is achieved by the adjustable stop pin 51, FIG. 1, which engages the rear surface of shroud 50.

As disclosed in full detail in U.S. Pat. No. 3,608,893, there are times when the suction finger is to be latched in its advanced signature gripping position. This is so in order to prevent delivery of a signature which is to be excluded for one reason or another from the group of signatures on the conveyor passing the supply hopper having the latched-up delivery finger. One form of latching is shown in FIGS. 1 and 1A. A latch arm or lever 66, having a notch 66N, is pivotally mounted at 67 on a support bracket 68. The latch is normally released, FIG. 1; the actuated or latching mode is shown in FIG.

1A. The lever 66 is elevated by retracting an air-operated link 69, raising notch 66N, capturing a roller 70 supported by the suction finger bell crank 24. Roller 70 and cam follower 32 are coaxial.

It will be noticed that the latching notch 66N is so configured to allow "lost motion" or "play" of the suction finger when nudged by the cam lobe 18 for reasons mentioned above. However, because of the permissive motion, though limited, the suction finger will nudge the signature supply stack. This is no particular problem if the stack is of optimum size (mass) under normal supervision, but if the stack is a thin one, as shown in FIG. 1, the forceful action of the cam lobe 18 on the follower 32 is sufficient to slightly elevate link 60, indexing the clutch a slight amount. The result of this is of course that the infeed conveyor is indexed forwardly, compacting the signature stack against the suction finger. This is not altogether unacceptable, even in the instance of a thin stack as shown in FIG. 1, but if a latched-up condition prevails for too many machine cycles, say five or six, the least of the results is that the pack of signatures becomes too tightly packed.

In accordance with the present invention, the one-way drive member (one-way clutch or pawl) which indexes the signature infeed conveyor is disabled when the suction finger is latched. More specifically, it will be recognized that actuation of the one-way clutch driver 46 involves a pawl connection in that the lug 62 of link 60 constitutes a pawl detent while the ear 64 of the clutch constitutes a pawl tooth. Under the present invention this pawl engagement is separated when the suction finger is latched.

According to FIG. 1, separation of the pawl engagement is achieved by an air-operated plunger 74 having it free end engaged with the underside of the clutch tooth 64. The plunger 74 is part of a piston 76 actuated by an air cylinder 78. The piston stroke against the pawl ear 64 is merely enough to advance the one-way clutch 46 clockwise a slight amount out of its retracted position so that it cannot be indexed by link 60 so long as the suction finger is latched. The control or valving for cylinder 78, FIG. 7, is timed to occur simultaneously with the downstroke of link 69 which sets the suction finger latch. Of course in all instances a solenoid could be substituted for an air cylinder.

Figure 5:
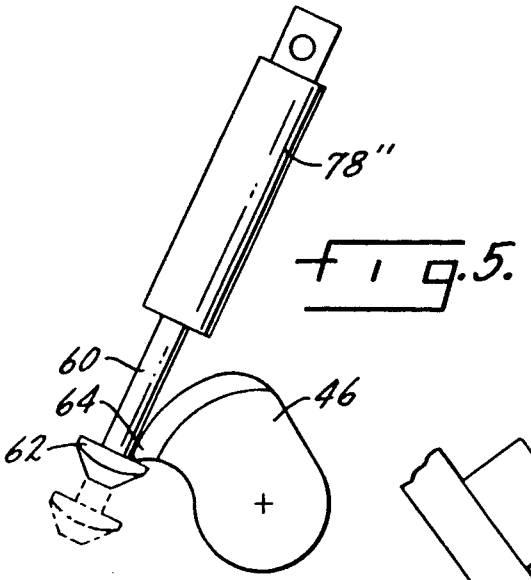
Figure 4:
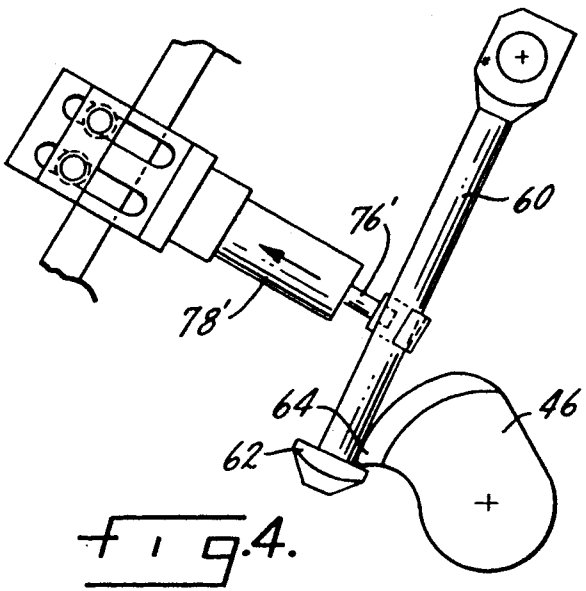

FIGS. 4 and 5 show additional embodiments for disengaging or separating the pawl elements employed for driving the one-way clutch. According to FIG. 4, the piston 76' of an air cylinder 78' is clamped to the drive link 60 so that when the piston 76' is retracted, detent 62 is displaced from engagement with the ear 64, which occurs of course when the suction finger is latched. According to FIG. 5, link 60 becomes the piston of a air cylinder 78" carried by the bell crank 24. By extending the piston-link 60 with air under pressure admitted to cylinder 78" concurrently with air under pressure used to retract the latch operating link 69, FIG. 1, the pawl connection is disconnected or separated so that in subsequent machine cycles, the clutch cannot be actuated, as long as the latch is in its latching position, FIG. 1A.

Of course, in all cases when the latch is released in any subsequent cycle, following a cycle in which the suction finger is latched, the air control used to disable the indexing pawl 62–64 also restores or reactivates the pawl connection by which the one-way drive is to be normally accomplished. There are many ways of accomplishing concurrent valving, especially since each air cylinder need only be a one-way cylinder: spring return, and extended or retracted as the case may be, by air under pressure. A generic, schematic arrangement is shown in FIG. 7. The air cylinder to activate link 69, FIG. 1, is identified by reference character 82. The air cylinder to separate the pawl elements 62–64 is identified by reference character 84, typical of the air cylinder according to FIGS. 1 and 6. A source of air under pressure is shown at 86. The air lines are joined by a three-way valve 88 which, in the position shown, is permissive of the pistons (air cylinders) being in the restored or inactive position. When the valve is timed by control member 90, actuated in a cycle when the suction finger is latched, the air lines to the cylinders are connected to the air source: the suction finger is latched and the pawl is disengaged. When the cylinders (pistons) are to be restored, the air lines are vented and the valve located (by spring return) in its neutral position.

Figure 6:
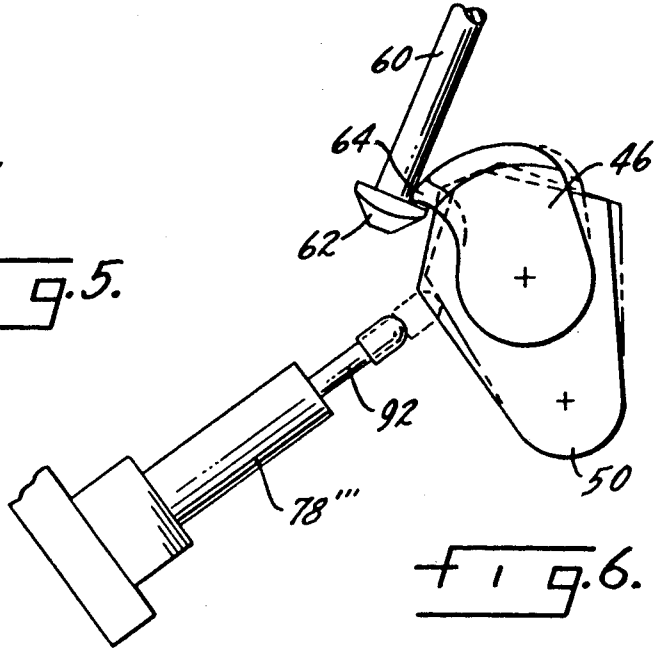
FIGS. 4, 5 and 6 are detail views of different ways in which the one-way drive may be disabled at the time the suction finger is in its latched position.

The preferred embodiment to effect pawl disengagement is shown in FIG. 6. An air cylinder 78''' is so positioned that its piston 92 is opposed to the rear edge of the shroud 50. When actuated, piston 92 is advanced to index or shift the shroud 50 by a slight amount so that notch 50N, FIG. 2, will carry the clutch pin 48 forward a sufficient amount to separate the pawl.

We claim:

1. In a cyclically operable signature machine having a supply hopper for a stack of vertically oriented signatures with the leadingmost signature positioned at the front of the hopper to be withdrawn in each cycle of the machine by a suction finger supported on a rocker which undergoes oscillation in each machine cycle first to present the finger to the leadingmost signature and then to withdraw the finger, an intermittently driven conveyor in the hopper incrementally operable in an indexing mode to advance the stack of signatures forwardly each time a signature is withdrawn, a one-way conveyor drive means operable from a restored position to an advanced position incrementally to advance the conveyor when a signature is withdrawn, a driving link supported by the rocker to be reciprocated thereby and having a detent pawl connection to a tooth on the one-way conveyor drive means thereby to index said one-way conveyor drive means to its advanced position during withdrawal of a signature and wherein the machine includes a latch which when actuated holds the suction finger in its withdrawing position during a machine cycle when a signature is not to be withdrawn from the hopper, the improvement characterized by means to separate the pawl connection to disable the one-way drive means when the suction finger is latched.

2. A machine according to claim 1 wherein the pawl connection is separated by displacing the detent from the tooth.

3. A machine according to claim 1 where the pawl connection is separated by displacing the tooth from the detent.

4. A machine according to claim 3 wherein the one-way drive means is a one-way clutch having its restored position limited by a control lever presenting a stop to a pin on the clutch defining the restored position of the clutch, characterized by means to shift the control lever to advance the clutch to separate the detent from the tooth when the suction finger is latched.

5. A machine according to claim 4 in which the means to shift the control lever is an air-operated piston in a cylinder, wherein the latch includes a link actuated by an air-operated cylinder and wherein a control means is employed to simultaneously supply air under pressure to both cylinders in a cycle of the machine when the suction finger is to be latched.

* * * * *